US010879026B1

(12) United States Patent
Yang et al.

(10) Patent No.: US 10,879,026 B1
(45) Date of Patent: Dec. 29, 2020

(54) ELECTRON EMISSION SOURCE FOR METAL-INSULATOR-SEMICONDUCTOR-METAL HAVING HIGHER KINETIC ENERGY FOR IMPROVED ELECTRON EMISSION AND METHOD FOR MAKING THE SAME

(71) Applicants: Tsinghua University, Beijing (CN); HON HAI PRECISION INDUSTRY CO., LTD., New Taipei (TW)

(72) Inventors: Xin-He Yang, Beijing (CN); Peng Liu, Beijing (CN); Shou-Shan Fan, Beijing (CN)

(73) Assignees: Tsinghua University, Beijing (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/899,788

(22) Filed: Jun. 12, 2020

(30) Foreign Application Priority Data

Dec. 24, 2019 (CN) ..... 2019 1 1351441

(51) Int. Cl.

| | |
|---|---|
| ***H01J 29/04*** | (2006.01) |
| ***H01J 31/12*** | (2006.01) |
| ***H01J 29/18*** | (2006.01) |
| ***H01J 19/24*** | (2006.01) |
| ***H01J 9/18*** | (2006.01) |

(52) U.S. Cl.
CPC ..... *H01J 19/24* (2013.01); *H01J 9/18* (2013.01)

(58) Field of Classification Search
CPC ..... H01J 19/24; H01J 9/18
See application file for complete search history.

(56) References Cited

U.S. PATENT DOCUMENTS

| | | | | |
|---|---|---|---|---|
| 9,373,475 | B2 * | 6/2016 | Liu | H01J 29/04 |
| 9,390,878 | B2 * | 7/2016 | Liu | H01J 1/312 |
| 2015/0206694 | A1 * | 7/2015 | Liu | H01J 29/04 257/10 |

OTHER PUBLICATIONS

Murakami et al., Electron emission Properties of graphene-oxide, Semiconductor planar type electron emission devices, IEEE, 2016 (Year: 2016).*

* cited by examiner

*Primary Examiner* — Tracie Y Green
(74) *Attorney, Agent, or Firm* — ScienBiziP, P.C.

(57) ABSTRACT

An electron emission source is provided. The electron emission source comprises a first electrode, an insulating layer, a semiconductor layer, and a second electrode. The first electrode, the insulating layer, the semiconductor layer, and the second electrode are successively stacked with each other. The second electrode is a graphene layer, and the graphene layer is an electron emission end to emit electrons.

13 Claims, 2 Drawing Sheets

ELECTRON EMISSION SOURCE FOR METAL-INSULATOR-SEMICONDUCTOR-METAL HAVING HIGHER KINETIC ENERGY FOR IMPROVED ELECTRON EMISSION AND METHOD FOR MAKING THE SAME

This application claims all benefits accruing under 35 U.S.C. § 119 from China Patent Application No. 201911351441.5, filed on Dec. 24, 2019, in the China National Intellectual Property Administration, the contents of which are hereby incorporated by reference. The application is also related to copending applications entitled, "ELECTRON EMISSION SOURCE AND METHOD FOR MAKING THE SAME", filed Jun. 12, 2020 (U.S. Ser. No. 16/199,794).

FIELD

The present disclosure relates to an electron emission source and method thereof.

BACKGROUND

Electron emission sources used in electron emission display devices are classified into two types: a hot cathode electron emission source type and a cold cathode electron emission source type. The cold cathode electron emission source comprises surface conduction electron-emitting sources, field electron emission sources, metal-insulator-metal (MIM) electron emission sources, and metal-insulator-semiconductor-metal (MISM) electron emission sources, etc.

In MISM electron emission sources, electrons need to have sufficient electron average kinetic energy to escape through the upper electrode to a vacuum. However, in traditional MISM electron emission sources, since the barrier is often higher than an average kinetic energy of electrons, the electron emission in this type of electron emission devices is low.

BRIEF DESCRIPTION OF THE DRAWINGS

Implementations of the present technology will now be described, by way of embodiments, with reference to the attached figures.

DETAILED DESCRIPTION

Figure 1:
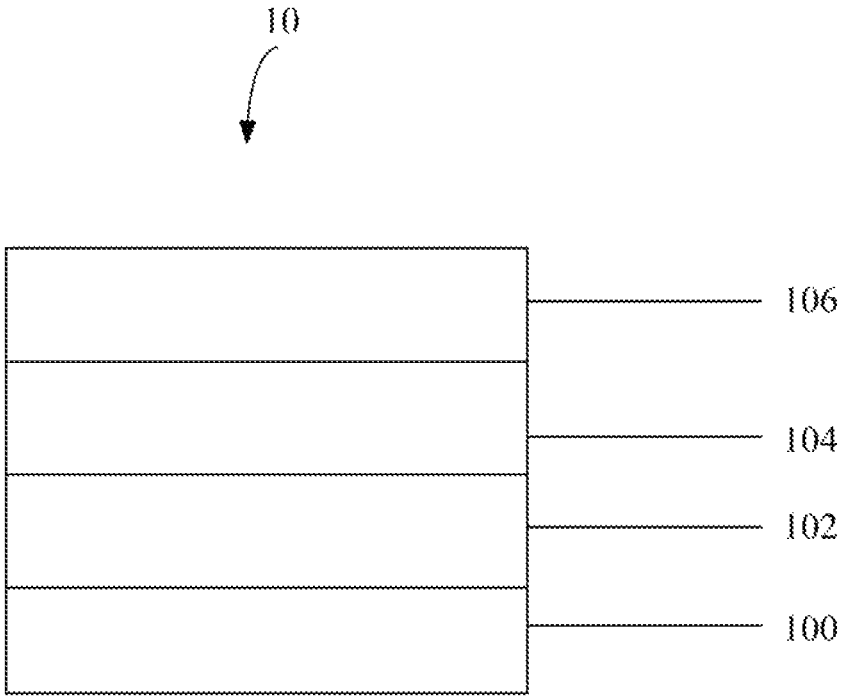
FIG. 1 is a schematic view of one embodiment of an electron emission source.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean "at least one".

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale, and the proportions of certain parts may be exaggerated to illustrate details and features of the present disclosure better.

Several definitions that apply throughout this disclosure will now be presented.

The term "comprise" or "comprising" when utilized, means "include or including, but not necessarily limited to"; it specifically indicates open-ended inclusion or membership in the so-described combination, group, series, and the like.

FIG. 1 illustrates an electron emission source 10 according to one embodiment of the present disclosure. The electron emission source 10 comprises a first electrode 100, an insulating layer 102, a semiconductor layer 104, and a second electrode 106. The first electrode 100, the insulating layer 102, the semiconductor layer 104, and the second electrode 106 are successively stacked with each other. The second electrode 106 is a graphene layer. The graphene layer is an electron emission end to emit electrons.

The first electrode 100 is a conductive metal film. A material of the first electrode 100 is copper, silver, iron, cobalt, nickel, chromium, molybdenum, tungsten, titanium, zirconium, hafnium, vanadium, niobium, tantalum, aluminum, magnesium, or metal alloy. A thickness of the first electrode 100 is ranged from about 10 nanometers to about 100 micrometers. In one embodiment, the thickness of the first electrode 100 is ranged from about 10 nanometers to about 50 nanometers. In another embodiment, the first electrode 100 is a copper metal film, and a thickness of the copper metal film is about 100 nanometers.

The insulating layer 102 is disposed on a surface of the first electrode 100, and the semiconductor layer 104 is disposed on a surface of the insulating layer 102 away from the first electrode 100. That is, the insulating layer 102 is disposed between the first electrode 100 and the semiconductor layer 104. In one embodiment, the insulating layer 102 comprises a first surface and a second surface opposite to the first surface, the first electrode 100 is disposed on the first surface of the insulating layer 102, and the semiconductor layer 104 is disposed on the second surface of the insulating layer 102. In another embodiment, the insulating layer 102 is in directly contact with the first electrode 100 and the semiconductor layer 104.

A material of the insulating layer 102 is alumina, silicon nitride, silicon oxide, tantalum oxide, boron nitride, or other materials. A thickness of the insulating layer 102 is ranged from about 0.1 nanometers to about 50 nanometers. In one embodiment, the material of the insulating layer 102 is boron nitride, and the thickness of the insulating layer 102 is ranged from about 0.3 nanometers to about 0.6 nanometers.

The semiconductor layer 104 is disposed on the surface of the insulating layer 102 away from the first electrode 100. The second electrode 106 is disposed on a surface of the semiconductor layer 104 away from the insulating layer 102. That is, the semiconductor layer 104 is disposed between the insulating layer 102 and the second electrode 106. In one embodiment, the semiconductor layer 104 is in directly contact with the insulating layer 102 and the second electrode 106.

A material of the semiconductor layer 104 can be a semiconductor material, such as zinc sulfide, zinc oxide, magnesium zinc oxide, magnesium sulfide, cadmium sulfide, cadmium selenide, zinc selenide, or molybdenum disulfide. A thickness of the semiconductor layer 104 is ranged from about 1 nanometer to about 50 nanometers. In one embodiment, the material of the semiconductor layer 104 is molybdenum disulfide, and the thickness of the semiconductor layer 104 is ranged from about 1 nanometer to about 5 nanometers.

The second electrode 106 is the graphene layer. The graphene layer comprises at least one graphene film. The graphene film, namely a single-layer graphene, is a single layer of continuous carbon atoms. The single-layer graphene is a nanometer-thick two-dimensional analog of fullerenes and carbon nanotubes. When the graphene layer comprises a plurality of graphene films, the plurality of graphene films may be stacked on each other or arranged coplanar side by side. A thickness of the graphene layer is in a range from about 0.34 nanometers to about 10 micrometers. For example, the thickness of the graphene layer can be 1 nanometer, 10 nanometers, 200 nanometers, 1 micrometer, or 10 micrometers. The graphene layer may consist of one single-layer graphene, the single-layer graphene has a thickness of a single carbon atom. That is, the thickness of the graphene film is a diameter of one single carbon atom. In one embodiment, the graphene layer is a pure graphene structure consisting of graphene. Because the single-layer graphene has great conductivity, electrons can be easily collected, and the electrons can quickly escape through the graphene layer and become emitted electrons.

The electron emission source 10 can be disposed on a surface of a substrate (not shown), and the first electrode 100 is disposed on the surface of the substrate. The substrate is used to support the electron emission source 10. A material of the substrate can be selected from rigid materials or flexible materials. The rigid materials may be glass, quartz, ceramics, diamond, or silicon wafers. The flexible materials may be plastics and resins.

The electron emission source 10 works in an alternating current (AC) driving mode by applying AC power to the electron emission source 10. The working principle of the electron emission source 10 is as follows: in a negative half cycle, the potential of the first electrode 100 is high, electrons are injected into the semiconductor layer 104 from the graphene layer, and an interface between the semiconductor layer 104 and insulating layer 102 forms an interface state. The electrons are stored at the interface, which is beneficial to reduce voltage. In a positive half cycle, due to the higher potential of the graphene layer, the electrons stored in the interface are pulled to the semiconductor layer 104 and accelerated in the semiconductor layer 104. Since the semiconductor layer 104 is in contact with the graphene layer and the thickness of the graphene layer is small, the electrons may be emitting through the graphene layer, thereby the emission current may be increased and the electron emission efficiency enhanced.

In one embodiment, the electron emission source 10 consists of the first electrode 100, a boron nitride layer, a molybdenum disulfide layer, and the graphene layer. When the insulating layer 102 is the boron nitride layer and the semiconductor layer 104 is the molybdenum disulfide layer, electrons can be adsorbed on an interface between the boron nitride layer and the molybdenum disulfide layer without being conducted away by the electrodes. When the semiconductor layer 104 is the molybdenum disulfide layer, electrons can be injected into a surface of the boron nitride layer. When the energy of the emitted electrons is higher than the work function of the molybdenum disulfide, the electrons can be emitted into a vacuum. The thinner the molybdenum disulfide layer is, the smaller the electron blocking is, and the applied voltage can be reduced.

In one embodiment, the electron emission source 10 works in an alternating current (AC) driving mode by applying AC power to the electron emission source 10. The working principle of the electron emission source 10 is: in the negative half cycle, the potential of the first electrode 100 is high, electrons are injected into the molybdenum disulfide layer from the graphene layer, and an interface between the molybdenum disulfide layer and the boron nitride layer forms an interface state. The electrons are stored at the interface, which is beneficial to reduce voltage. In the positive half cycle, due to the higher potential of the graphene layer, the electrons stored in the interface are pulled to the molybdenum disulfide layer and accelerated in the molybdenum disulfide layer. Since the molybdenum disulfide layer is in contact with the graphene layer and the thickness of the graphene layer is small, e.g., the graphene layer may has a thickness of one single carbon atom, the electrons can be quickly emitted from the graphene layer, thereby the emission current may be increased and the electron emission efficiency improved.

Figure 2:
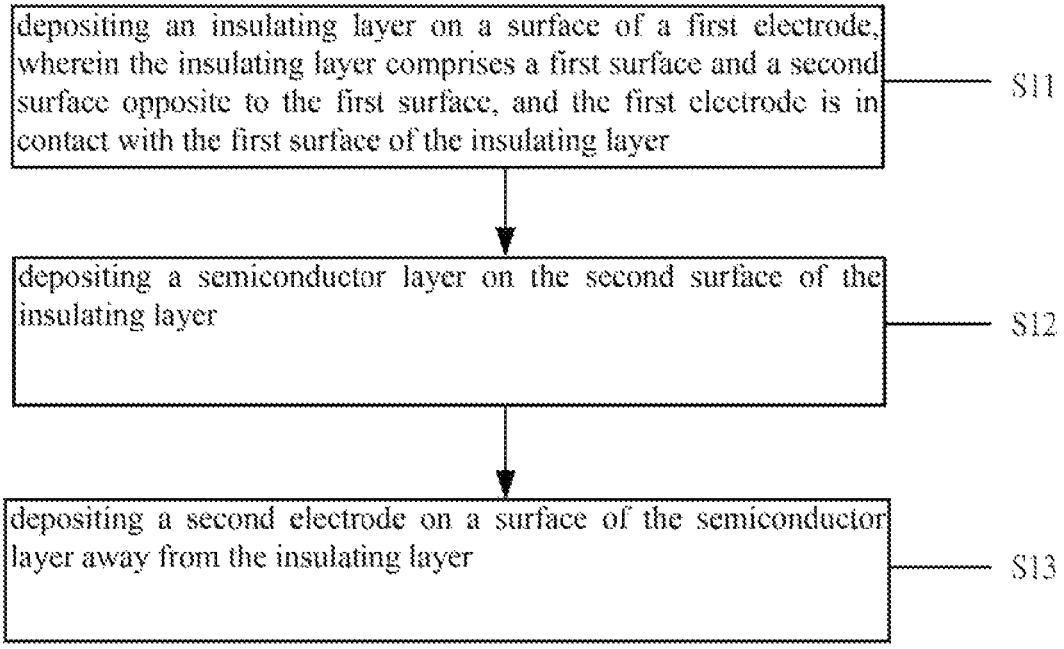
FIG. 2 is a flowchart of one embodiment of a method for making the electron emission source.

FIG. 2 illustrates a flowchart of one embodiment of a method for making the electron emission source 10. The method comprises:

(S11) depositing the insulating layer 102 on the surface of the first electrode 100, wherein the insulating layer 102 comprises a first surface and a second surface opposite to the first surface, and the first electrode 100 is in contact with the first surface of the insulating layer 102;

(S12) depositing the semiconductor layer 104 on the second surface of the insulating layer 102; and (S13) depositing the second electrode 106 on the surface of the semiconductor layer 104 away from the insulating layer 102.

At block S11, the first electrode 100 may be formed by a magnetron sputtering method, a vapor deposition method, or an atomic layer deposition method. In one embodiment, the first electrode 100 is a copper metal film, the copper metal film is formed by the vapor deposition method, and the thickness of the first electrode 100 is about 100 nanometers.

The insulating layer 102 is formed by a magnetron sputtering method, a vapor deposition method, or an atomic layer deposition method. In one embodiment, the insulating layer 102 is a boron nitride layer, the boron nitride layer is formed by the vapor deposition method, and the thickness of the boron nitride layer is ranged from about 0.3 nanometers to about 0.6 nanometers.

At block S12, the semiconductor layer 104 is formed on the second surface of the insulating layer 102 by a magnetron sputtering method, a thermal evaporation method, or an electron beam evaporation method. In one embodiment, the insulating layer 102 is a boron nitride layer, and the semiconductor layer 104 is a molybdenum disulfide layer. The molybdenum disulfide layer is formed on a second surface of the boron nitride layer. The second surface of the boron nitride layer is away from the first electrode 100. The thickness of the molybdenum disulfide layer is ranged from about 1 nanometer to about 5 nanometers.

At block S13, the second electrode 106 can be prepared and transferred to the surface of the semiconductor layer 104 away from the insulating layer 102 by graphene powder or by a graphene film. The graphene powder has a film shape after being transferred to the surface of the semiconductor layer 104. The graphene film can also be prepared by a chemical vapor deposition (CVD) method, a mechanical peeling method, an electrostatic deposition method, a silicon carbide (SiC) pyrolysis, or an epitaxial growth method. The graphene powder can be prepared by a liquid phase separation method, an intercalation stripping method, cutting carbon nanotubes, a preparation solvothermal method, or an organic synthesis method.

In one embodiment, the graphene layer 106 is one graphene film. The graphene film, namely a single-layer graphene, is a single layer of continuous carbon atoms. The single-layer graphene is a nanometer-thick two-dimensional analog of fullerenes and carbon nanotubes. The graphene layer consists of one single-layer graphene, the single-layer graphene has a thickness of a single carbon atom. That is, the thickness of the graphene film is a diameter of one single carbon atom.

The method for making the electron emission source 10 is simple and easy to operate. The electron emission source 10 formed by this method has the following beneficial characteristics. The electron emission source 10 works in an alternating current (AC) driving mode by applying AC power to the electron emission source 10. The working principle of the electron emission source 10 is as follows: in a negative half cycle, the potential of the first electrode 100 is high, electrons are injected into the semiconductor layer 104 from the graphene layer, and an interface between the semiconductor layer 104 and insulating layer 102 forms an interface state. The electrons are stored at the interface, which is beneficial to reduce voltage. In a positive half cycle, due to the higher potential of the graphene layer, the electrons stored in the interface state are pulled to the semiconductor layer 104 and accelerated in the semiconductor layer 104. Since the semiconductor layer 104 is in contact with the graphene layer and the thickness of the graphene layer is small, the electrons can quickly escape through the graphene layer to become emitted electrons, which can increase the emission current and the electron emission efficiency.

Even though numerous characteristics and advantages of certain inventive embodiments have been set out in the foregoing description, together with details of the structures and functions of the embodiments, the disclosure is illustrative only. Changes may be made in detail, especially in matters of arrangement of parts, within the principles of the present disclosure to the full extent indicated by the broad general meaning of the terms in which the appended claims are expressed.

Depending on the embodiment, certain of the steps of methods described may be removed, others may be added, and the sequence of steps may be altered. It is also to be understood that the description and the claims drawn to a method may comprise some indication in reference to certain steps. However, the indication used is only to be viewed for identification purposes and not as a suggestion as to an order for the steps.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure up to, and including the full extent established by the broad general meaning of the terms used in the claims. It will therefore be appreciated that the embodiments described above may be modified within the scope of the claims.

What is claimed is:

1. An electron emission source, comprising: a first electrode, an insulating layer, a semiconductor layer, and a second electrode successively stacked in a said order, wherein the second electrode is a graphene layer, and the graphene layer defines an electron emission end to emit electrons, the material of the semiconductor layer is molybdenum disulfide, and a thickness of the semiconductor layer is ranged from approximately 1 nanometer to approximately 5 nanometers.

2. The electron emission source of claim 1, wherein a thickness of the graphene layer is in a range from approximately 0.34 nanometers to approximately 10 micrometers.

3. The electron emission source of claim 1, wherein the graphene layer consists of a single-layer graphene, and the single-layer graphene has a thickness of a single carbon atom.

4. The electron emission source of claim 1, wherein a material of the semiconductor layer is zinc sulfide, zinc oxide, magnesium zinc oxide, magnesium sulfide, cadmium sulfide, cadmium selenide, zinc selenide, or molybdenum disulfide.

5. The electron emission source of claim 1, wherein a material of the insulating layer is alumina, silicon nitride, silicon oxide, tantalum oxide, or boron nitride.

6. The electron emission source of claim 5, wherein the material of the insulating layer is boron nitride, and a thickness of the insulating layer is ranged from approximately 0.3 nanometers to approximately 0.6 nanometers.

7. The electron emission source of claim 1, wherein the electron emission source consists of the first electrode, a boron nitride layer, a molybdenum disulfide layer, and the graphene layer successively stacked in the said order.

8. A method for making an electron emission source, the method comprising:

depositing an insulating layer on a surface of a first electrode, wherein the insulating layer comprises a first surface and a second surface opposite to the first surface, and the first electrode is in contact with the first surface of the insulating layer;

depositing a semiconductor layer on the second surface of the insulating layer; and depositing a second electrode on a surface of the semiconductor layer away from the insulating layer, wherein the second electrode is a graphene layer, the graphene layer comprises at least one single-layer graphene, and the at least one single-layer graphene has a thickness of a single carbon atom.

9. The method of claim 8, wherein the graphene layer consists of a single-layer graphene, and the single-layer graphene has a thickness of a single carbon atom.

10. An electron emission source, consisting of: a first electrode, a boron nitride layer, a molybdenum disulfide layer, and a second electrode successively stacked in a said order, wherein the second electrode is a graphene layer, and the graphene layer defines an electron emission end to emit electrons.

11. The electron emission source of claim 10, wherein a thickness of the graphene layer is in a range from approximately 0.34 nanometers to approximately 10 micrometers.

12. The electron emission source of claim 10, wherein the graphene layer consists of a single-layer graphene, and the single-layer graphene has a thickness of a single carbon atom.

13. The electron emission source of claim 10, wherein a thickness of the boron nitride layer is ranged from approximately 0.3 nanometers to approximately 0.6 nanometers.

* * * * *